US010283306B2

(12) United States Patent
Füssl

(10) Patent No.: US 10,283,306 B2
(45) Date of Patent: May 7, 2019

(54) BENT MIDI OR SAFETY FUSE

(75) Inventor: Peter Füssl, Vilsbiburg (DE)

(73) Assignee: LISA DRAEXLMAIER GMBH, Vilsbiburg (DE)

( * ) Notice: Subject to any disclaimer, the term of this patent is extended or adjusted under 35 U.S.C. 154(b) by 327 days.

(21) Appl. No.: 14/122,759

(22) PCT Filed: May 22, 2012

(86) PCT No.: PCT/EP2012/059493
§ 371 (c)(1),
(2), (4) Date: Nov. 27, 2013

(87) PCT Pub. No.: WO2012/163730
PCT Pub. Date: Dec. 6, 2012

(65) Prior Publication Data

US 2014/0097932 A1 Apr. 10, 2014

(30) Foreign Application Priority Data

May 31, 2011 (DE) ..... 20 2011 050 310 U

(51) Int. Cl.
*H01H 85/143* (2006.01)
*H01H 85/044* (2006.01)
(Continued)

(52) U.S. Cl.
CPC ..... *H01H 85/143* (2013.01); *H01H 85/044* (2013.01); *H01H 85/2045* (2013.01);
(Continued)

(58) Field of Classification Search
CPC .. H01H 85/0456; H01H 85/143; H01H 85/15; H01H 85/153; H01H 2085/0555;
(Continued)

(56) References Cited

U.S. PATENT DOCUMENTS 4,751,490 A * 6/1988 Hatagishi ..... H01H 85/10 337/166
5,229,739 A * 7/1993 Oh ..... H01H 69/02 337/255
(Continued)

FOREIGN PATENT DOCUMENTS

DE 92 03 421 U1 4/1992
DE 299 12 797 U1 12/1999
(Continued)

OTHER PUBLICATIONS

International Search Report, issued by European Patent Office (as the International Searching Authority), dated Aug. 21, 2012, in international application No. PCT/EP2012/059493, and English translation of the International Search Report (7 pages).
(Continued)

*Primary Examiner* — Jacob R Crum
(74) *Attorney, Agent, or Firm* — Finnegan, Henderson, Farabow, Garrett & Dunner LLP

(57) ABSTRACT

A safety fuse includes a housing, a first contact blade having a protruding portion protruding from the housing along a first direction, a second contact blade having a protruding portion protruding from the housing, and a fusion section enclosed in the housing and connecting the first contact blade and the second contact blade. The protruding portion of the first contact blade includes two lateral edges extending in the first direction and a linear bend arranged on one of the lateral edges. The bend extends in a second direction perpendicular to the first direction.

11 Claims, 1 Drawing Sheet

(51) Int. Cl.
*H01H 85/20* (2006.01)
*H01H 85/24* (2006.01)
*H01H 85/055* (2006.01)

(52) U.S. Cl.
CPC ..... *H01H 85/24* (2013.01); *H01H 2085/0555* (2013.01); *H01H 2085/2055* (2013.01)

(58) Field of Classification Search
CPC ..... H01H 2085/2055; H01H 2085/206; H01H 85/044; H01H 85/2045; H01H 85/24
USPC ..... 337/191, 254
See application file for complete search history.

(56) References Cited

U.S. PATENT DOCUMENTS 5,805,047 A * 9/1998 De Villeroche ..... B60R 16/04 337/142
6,456,188 B1 * 9/2002 Tsuchiya ..... H01H 85/205 337/187
2001/0012736 A1 * 8/2001 Miyajima ..... H02G 3/16 439/721
2004/0124963 A1 * 7/2004 Nakamura ..... H01H 85/044 337/256
2006/0205249 A1 * 9/2006 Higuchi ..... H01H 85/044 439/76.2
2011/0267168 A1 * 11/2011 Tong ..... H01H 85/044 337/187
2011/0285496 A1 * 11/2011 Urrea ..... H01H 85/12 337/188

FOREIGN PATENT DOCUMENTS

DE 103 45 994 A1 4/2004
DE 10 2005 027 681 A1 12/2006
EP 0 699 565 A2 3/1996
EP 0 803 889 A2 10/1997

OTHER PUBLICATIONS

Written Opinion of the International Searching Authority, issued by International Searching Authority, dated Aug. 21, 2012, in international application No. PCT/EP2012/059493, and English translation of the Written Opinion (10 pages).
International Preliminary Report on Patentability, issued by the International Bureau of WIPO, dated Dec. 2, 2013, in international application No. PCT/EP2012/059493, and English translation of the International Preliminary Report on Patentability (12 pages).

* cited by examiner

BENT MIDI OR SAFETY FUSE

CROSS-REFERENCE TO RELATED APPLICATIONS

This is a U.S. National Phase of PCT/EP2012/059493, filed May 22, 2012, which claims the benefit of priority to German Patent Application No. 20 2011 050 310.0, filed May 31, 2011, the contents of both of which are incorporated herein by reference.

TECHNOLOGY FIELD

The invention relates to a safety fuse for use in a motor vehicle. Such safety fuses are used to protect an electrical circuit from overloading. The invention furthermore relates to a bus bar and an arrangement with one or more such fuses.

BACKGROUND

So-called MIDI fuses are known in the prior art, as shown in FIG. 1, or described in German patent DE 10 2005 027 681 A1.

The fuse shown in FIG. 1 has a first contact blade 11, a second contact blade 12 and a fusion section (not shown), where the fusion section connects the first contact blade 11 with the second contact blade 12. The first contact blade 11, the second contact blade 12, and the fusion section are arranged in a common plane. The fusion section is enclosed by a housing 13, which is made of a nonconductive material, such as plastic. At least one portion of the first contact blade 11, and at least one portion of the second contact blade 12, protrude freely in opposite directions from housing 13. The fuse 10 has an opening 14 in the portion of the first contact blade 11 that protrudes from housing 13, allowing the fuse to be fastened to another part. Moreover, housing 13 protrudes relative to the common plane on either side of the plane and at about the same distance away from the plane.

If fastening fuse 10, shown in FIG. 1, to another part, e.g., with a screw, the torque applied to establish the screw connection is initiated by friction in the first contact blade 11, e.g., between the screw head and the first contact blade 11, causing fuse 10 to rotate, or when fastening the second contact blade 12 to another part, the portion between the first contact blade 11 and the second contact blade 12 is subjected to torque. A large part of the torque is absorbed by housing 13, whereby a part of the torque acts on the fusion section, i.e., mechanically loading the fusion section. This mechanical load affects the triggering properties of the melting temperature range.

SUMMARY

An object of the invention is to provide a fuse, in which a mechanical load of the melting temperature range is avoided.

This object is achieved by the fuse according to appended claims.

The invention is based on a fuse, especially for use in a motor vehicle, e.g., a MIDI fuse, as described at the beginning.

The invention provides that a preferably form-locking securing element, in particular an anti-rotation element, is arranged on an area or a portion protruding from a housing of a first contact blade of the fuse. The securing element preferably extends approximately vertically to the direction, in which the portion of the first contact blade protrudes from the housing, and/or approximately vertically or perpendicularly to a plane defined by the portion protruding from the housing of the first contact blade. The securing element is used to secure the fuse on a device, in particular a fastening element and/or a connecting element, e.g., a base or a cable lug, thereby diverting a lateral force acting on the fastening or connecting element and/or the fuse on the fastening or connecting element, due to the preferably rail- and/or flank-like securing element, in particular a guide rail, thereby preventing the application of a force on the fusion section and/or the housing. Specifically, the securing element prevents rotation of the fuse or the first contact blade, particularly in a plane defined by the portion of the first contact blade protruding from the housing, relative to the device, especially the base on which the first contact blade may be fastened.

The first contact blade and the fusion section, and optionally a second contact blade, may be arranged in a common plane or in planes arranged parallel to one another.

One embodiment according to the invention provides that at least one bend is arranged on at least one lateral edge of the portion of the first contact blade protruding from the housing. In the preferred embodiment with two lateral edges, the opposing lateral edges extend in the direction in which the portion of the first contact blade protrude from the housing. For example, the two lateral edges laterally define the first contact blade.

In an arrangement in which the fuse is mounted on a base, the base is enclosed between the bends of the first contact blade. The bends thus encompass the base at least partially, and preferably on its shoulders. These bends advantageously provides rotation prevention between the base and the first contact blade. This rotation prevention prevents rotation of the fuse of, in particular, the first contact blade, in the plane of the first contact blade relative to the base. The base may be made of plastic.

Preferably, the first contact blade is fastened to the base by a screw connection. If a torque is applied to establish the screw connection in the first contact blade, this torque is transmitted to the base via the bends encompassing the base in order not to subject the fusion section to the said torque.

Preferred embodiments of the invention are described below with reference to the figures. The features disclosed there, separately and in any combination, represent an advantageous further development of the object of the invention.

DESCRIPTION OF THE EMBODIMENTS

Figure 1:
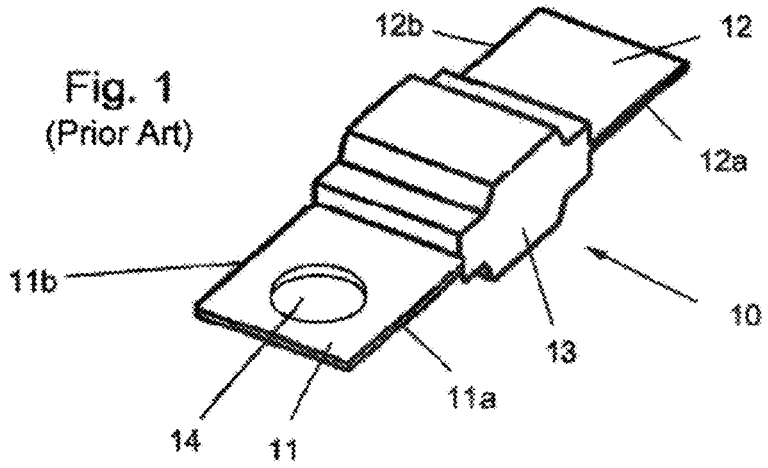
Fig. 1 (Prior Art)
FIG. 1 is a perspective view of a prior-art fuse.

In the following figures, similar elements are each denoted by the same reference numerals.

Figure 2:
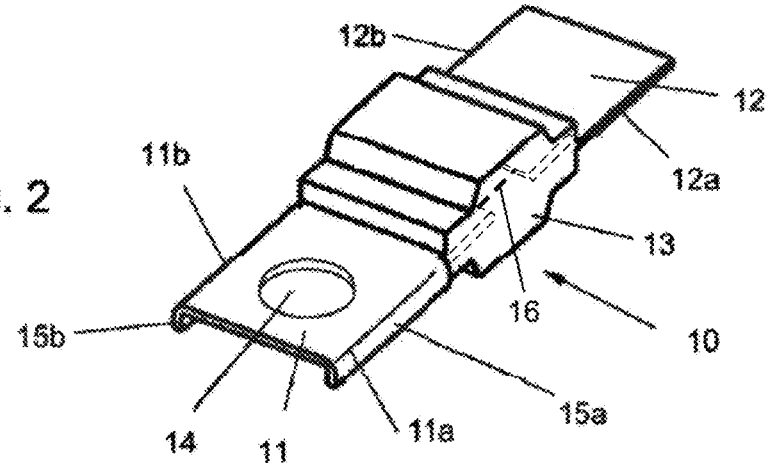
FIG. 2 is a perspective view of a fuse according to invention.

FIG. 2 shows a fuse 10, which is a further development according to invention of fuse 10 of FIG. 1.

Fuse 10 of FIG. 2 has a first contact blade 11, a second contact blade 12, and a fusion section 16 (schematically depicted using dashed lines) connecting the first contact blade 11 with the second contact blade 12. The fusion section 16 can be a fusion section described, e.g., in the aforementioned German patent DE 10 2005 027 681 A1.

Compared with the first and second contact blades 11, 12, the conduction cross-section of the fusion section 16 is smaller. If a current flowing between the first contact blade 11 and the second contact blade 12 exceeds the rated current, i.e., its amperage exceeds the amperage allowed for continuous operation of fuse 10, the fusion section 16 overheats and melts or blows, thus interrupting the current flowing between the first contact blade 11 and the second contact blade 12.

The first contact blade 11, the second contact blade 12, and the fusion section 16 are made of an electrically conductive material, e.g., metal. Preferred metals are copper or zinc, or copper- or zinc-based alloys. Contact tongues 11, 12, and the fusion section 16 are preferably punched from a plate-shaped semifinished product, e.g., a metal sheet, particularly a copper or zinc plate, or a tin-coated copper plate. Contact tongues 11, 12 and the fusion section 16 are thus integral.

The first contact blade 11 and the fusion section 16, and in this example, also the second contact blade 12, are arranged in a common plane. In principle, it would be possible also to arrange the first contact blade 11, the fusing section, and in particular the second contact blade 12 in parallel and spaced-apart planes.

Moreover, fuse 10 has a housing 13 that encloses fusion section 16, from which at least a portion of the first contact blade 11, and at least a portion of the second contact blade 12 protrude freely. The first contact blade 11 and the second contact blade 12 protrude in opposite directions from housing 13. The portion protruding from housing 13 of the first contact blade 11 has an opening 14 with a closed, more specifically a circular cross-section. Opening 14 serves to fasten fuse 10 to a base 31, as described below. The second contact blade 12 in the shown embodiment has no opening. Advantageously, the opening is punched during the punching of contact blades 11, 12 and the fusion section 16.

Whereas the lateral edges 11*a*, 11*b* in the fuse shown in FIG. 1 and extending in the direction in which the portion protruding from the housing of the first contact blade 11 protrudes from housing 13 are not bent, bends 15*a*, 15*b* are arranged on the opposite lateral edges 11*a*, 11*b* of the first contact blade 11 of fuse 10 in FIG. 2. In the example shown, a single bend 15*a*, 15*b* is arranged and shaped as a straight or plane flank for each lateral edge 11*a*, 11*b*. Alternatively, on either lateral edge 11*a*, 11*b*, several bends 15*a*, 15*b* may be arranged. The bends 15*a*, 15*b* or flanks may be arranged at approximately right angles relative to the common plane or the planes parallel to one another of the fusing section, and the first contact blade 11 or the plane of the first contact blade 11. In the shown example, bends 15*a*, 15*b* extend along the whole length of the portion protruding from housing 13 of the first contact blade 11.

As the bends 15*a*, 15*b* are formed on lateral edges 11*a*, 11*b*, they can be relatively easily produced during or after punching by reshaping, e.g., by bending. Thus, the first contact blade 11, the second contact blade 12, the fusing section, and the bends 15*a*, 15*b* may be made by punching and bending the plate-shaped semifinished product.

The first contact blade 11, may have, e.g., a portion enclosed by housing 13 (not shown). This is likewise the case for the second contact blade 12. The lateral edges of the portion protruding from housing 13 of the first contact blade 11 may have bends 15*a*, 15*b*, whereas the lateral edges of the portion enclosed by housing 13 of the first contact blade 11 have no bends.

The fusion section 16 preferably joins the first contact blade 11 and the second contact blade 12, in particular the portion enclosed by housing 13 of the first contact blade 11 and the portion enclosed by housing 13 of the second contact blade 12. Housing 13 is fastened to the enclosed portion of the first contact blade 11 and/or encompasses snugly the first contact blade 11, in the area where the portion of contact blade 11 is arranged in housing 13. The same applies to the second contact blade 12. Housing 13 forms a slit-shaped opening for the first contact blade 11, as well as the second contact blade 12.

Housing 13 protrudes relative to the common plane, in which the first contact blade 11 and the second contact blade, as well as the fusing section, are arranged, on either side of the plane at about the same distance away from the plane. This result in a compact design for fuse 10.

Figure 3:
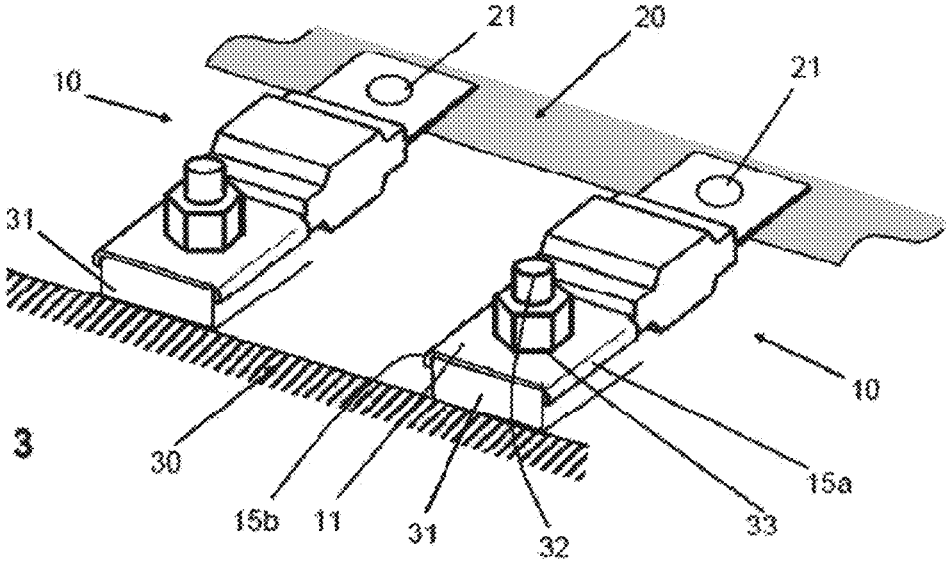
FIG. 3 shows an arrangement of several fuses from FIG. 2, arranged on a common bus bar.

As can be best seen in FIG. 3, several fuses 10 are attached to a common bus bar 20 in preferred further developments. Alternatively, fuse 10 may be formed integrally with bus bar 20.

If changes are made in the fusion sections 16, the punching tool for the fusion sections 16 formed integrally with bus bar 20 needs changing, whereas if fuses 10 are attached separately to bus bar 20, changes can very easily be done by replacing the fuses 10 to be added to bus bar 20 resulting in tooling cost savings.

The second contact blade 12 is preferably placed against bus bar 20, in particular flat against bus bar 20. Bus bar 20 and contact blade 12 are preferably connected with a non-detachable joint 21, i.e., separation of the second contact blade 12 from bus bar 20 is only possible by causing irreversible destruction of joint 21. Alternatively, detachable joints, such as screw connections may be provided in order to connect the second contact blade 12 with bus bar 20.

In the example shown, the second contact blade 12 is connected to bus bar 20 by a press joint 21, which joint 21 is of the non-detachable kind. Press joints are known in the art as TOX® joints.

FIG. 3 furthermore shows an arrangement with a base 31, on which fuse 10 of FIG. 2 is mounted.

Base 31 is formed of a plastic material, and preferably integrally with a carrier 30. Base 31 comprises a screw bolt 32 or a screw-like device with a threaded section, a supporting area and a clamping area. Screw bolt 32 may be clamped by pressing or inserting screw bolt 32 into the plastics material, or preferably by extrusion coating of screw bolt 32 with plastic during the manufacturing of base 31. Besides supporting fuse 10 at the base 31 (i.e., inside), enclosure of fuse 10 may also take place from the outside. In this case, outer abutment surfaces are guided along the contour of fuse 10. The tuning of the width of base 31 relative to the width of the fuse is optimized in terms of dimensional clearance.

Base 31 is enclosed between the bends 15*a*, 15*b* of the first contact blade 11, in particular with no or only very slight clearance. Thus, the distance between bends 15*a*, 15*b* of the first contact blade 11 is approximately the width of base 13 arranged between these bends 15*a*, 15*b*. This prevents rotation of the first contact blade 11 relative to base 31 in the plane of the first contact blade 11. A torque applied to the first contact blade 11 due to friction by the screw connection, with which the first contact blade 11 is fastened to base 31, is transferred to based 31 via bends 15*a*, 15*b* enclosing base 31, such that the fusion section 16 is unaffected by the torque.

The portion of the first contact blade 11 protruding from housing 13 is enclosed, in particular clamped, between base 31 and a threaded means 33, which in the shown embodiment is a nut. Base 31 of plastic has a threaded insert in the form of a screw bolt 32. Screw bolt 32 is connected to an electrical conductor leading to one or more appliances. Screw bolt 32 extends through opening 14 of the first contact blade 11, whereby nut 33 is screwed onto the screw bolt 32.

Alternatively, the threaded insert inserted in base 31 may be a nut, into which the threaded means in the shape of a screw is fastened, whereby the first contact blade 11 is enclosed, in particular clamped, between the screw head and base 31.

The bends 15*a*, 15*b* thus prevent rotation of the first contact blade 11 relative to base 31 about the screw axis of the threaded means and/or the threaded insert.

The shape of fuse 10 may be designed asymmetrically relative to its contact blades 11, 12, i.e., the first contact blade 11 provided with the opening is longer than the second contact blade 12. Thus, a sufficient clearance, e.g., for mounting large lugs or other connection devices, is created between the fastened cable lug and the fuse housing 13, which is preferably made of plastic.

The invention claimed is:

1. A fuse arrangement for a bus bar having a plurality of bases, the fuse arrangement comprising:

the plurality of bases, each of the bases extending outward from a carrier surface, such that each respective base has first and second opposing sides that extend perpendicular from the carrier surface;

a plurality of fuses, each of the fuses configured to be arranged on a respective one of the plurality of bases and connected to the bus bar, each of the fuses including:

a housing;

a first contact blade arranged partially in the housing and coupled to a fusion section, the first contact blade including a first protruding portion protruding from the housing along a first direction, the first protruding portion including:

a first lateral edge extending in the first direction along the length of a first side of the first protruding portion;

a second lateral edge extending in the first direction along the length of a second side, opposing the first side, of the first protruding portion; and first and second bend elements, the lengths of the first and second bend elements respectively arranged to extend continuously along the length of the first and second lateral edges, the bend elements extending in a second direction perpendicular to the first direction and extending linearly from the respective first and second lateral edge toward the carrier surface, the bend elements being engaged with the base and the bend elements enclosing the base between the bend elements such that the bend elements enclose the first and second opposing sides of the base along the length of the first and second lateral edges, wherein the bend elements are configured to absorb torque, and to protect the fusion section from absorbing torque, when mounting the first contact blade to the base; and a second contact blade arranged partially in the housing and coupled to the fusion section, the second contact blade including a second protruding portion being substantially flat and protruding from the housing along a third direction opposite to the first direction, wherein the second substantially-flat protruding portion is connected directly to the bus bar by a non-detachable press joint and further includes:

a first lateral edge extending in the third direction along the length of a first side of the second protruding portion, the first lateral edge being free of bend elements; and a second lateral edge extending in the third direction along the length of a second side, opposing the first side, of the second protruding portion, the second lateral edge being free of bend elements.

2. A fuse arrangement for a bus bar having a base, the fuse arrangement comprising:

the base extending outward from a carrier surface, such that the base has first and second opposing sides that extend perpendicular from the carrier surface; and a fuse configured to be mounted on the base, the fuse including:

a housing;

a first contact blade arranged partially in the housing and coupled to a fusion section, the first contact blade including a first protruding portion protruding from the housing along a first direction, the first protruding portion including:

a first lateral edge extending in the first direction along the length of a first side of the first protruding portion;

a second lateral edge extending in the first direction along the length of a second side, opposing the first side, of the first protruding portion; and first and second bend elements, the lengths of the first and second bend elements respectively arranged to extend continuously along the length of the first and second lateral edges, the bend elements extending in a second direction perpendicular to the first direction and extending linearly from the respective first and second lateral edge toward the carrier surface; and a second contact blade arranged partially in the housing and coupled to the fusion section, the second contact blade including a second protruding portion being substantially flat and protruding from the housing along a third direction opposite to the first direction, wherein the second substantially-flat protruding portion is connected directly to the bus bar, and further includes:

a first lateral edge extending in the third direction along the length of a first side of the second protruding portion, the first lateral edge being free of bend elements; and a second lateral edge extending in the third direction along the length of a second side, opposing the first side, of the second protruding portion, the second lateral edge being free of bend elements;

wherein the bend elements are engaged with the base, and the bend elements enclose the base between the bend elements such that the bend elements enclose the first and second opposing sides of the base along the length of the first and second lateral edges, wherein the bend elements are configured to absorb torque, and to protect the fusion section from absorbing torque, when mounting the first contact blade to the base.

3. An arrangement according to claim 2, further comprising:

a screw connection fastening the first contact blade to the base.

4. An arrangement according to claim 2, further comprising:

a threaded component for fixing the first protruding portion to the base, such that the first protruding portion is enclosed between the base and the threaded component.

5. An arrangement according to claim 4, wherein:

the base is made of plastic and includes a threaded insert; and the threaded component is mounted on the threaded insert.

6. An arrangement according to claim 5, wherein:

the threaded insert is a screw bolt, and the threaded component is a screw nut.

7. An arrangement according to claim 2, wherein a distance between the bend elements approximately equals a width of the base.

8. An arrangement according to claim 1, further comprising:

a plurality of screw connections each fastening the first contact blade of one of the fuses to one of the plurality of bases.

9. An arrangement according to claim 1, further comprising:

a plurality of threaded components each fixing the first protruding portion of one of the fuses to one of the plurality of bases, such that the first protruding portion is enclosed between the respective base and the threaded component.

10. An arrangement according to claim 9, wherein:

the plurality of bases are made of plastic and include a plurality of threaded inserts, and each of the threaded components is mounted on one of the threaded inserts.

11. An arrangement according to claim 10, wherein:

the threaded inserts are screw bolts, and the threaded components are screw nuts.

* * * * *